US010513937B2

(12) United States Patent
Koda

(10) Patent No.: US 10,513,937 B2
(45) Date of Patent: Dec. 24, 2019

(54) STEAM TURBINE

(71) Applicant: MITSUBISHI HEAVY INDUSTRIES COMPRESSOR CORPORATION, Tokyo (JP)

(72) Inventor: Takuro Koda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 57 days.

(21) Appl. No.: 15/572,528

(22) PCT Filed: Aug. 21, 2015

(86) PCT No.: PCT/JP2015/073513
§ 371 (c)(1),
(2) Date: Nov. 8, 2017

(87) PCT Pub. No.: WO2017/033227
PCT Pub. Date: Mar. 2, 2017

(65) Prior Publication Data

US 2018/0156050 A1 Jun. 7, 2018

(51) Int. Cl.
*F01D 9/04* (2006.01)
*F01D 1/02* (2006.01)
*F01D 5/06* (2006.01)

(52) U.S. Cl.
CPC ..... *F01D 9/041* (2013.01); *F01D 1/02* (2013.01); *F01D 5/06* (2013.01); *F05D 2220/31* (2013.01); *F05D 2240/60* (2013.01)

(58) Field of Classification Search
CPC ... F01D 9/041; F01D 1/02; F01D 5/06; F01D 11/04; F01D 11/10; F01D 25/00; F05D 2220/31; F05D 2240/60
(Continued)

(56) References Cited

U.S. PATENT DOCUMENTS 5,328,326 A * 7/1994 Gros ..... F01D 1/10 415/115
6,896,482 B2 * 5/2005 Parry ..... F01D 11/025 277/412
(Continued)

FOREIGN PATENT DOCUMENTS

JP S59-130005 U 8/1984
JP S61-070102 A 4/1986
(Continued)

OTHER PUBLICATIONS

Written Opinion for corresponding International Application No. PCT/JP2015/073513, dated Nov. 24, 2015 (7 pages).
(Continued)

*Primary Examiner* — Joseph J Dallo
*Assistant Examiner* — Yi-Kai Wang
(74) *Attorney, Agent, or Firm* — Osha Liang LLP

(57) ABSTRACT

A steam turbine includes: a rotor shaft including a shaft core and a disk portion fixed to the shaft core and that expands toward a radially outer side in the shaft core; rotor blade rows that are fixed to an outer periphery of the disk portion and arranged in an axial direction in which the shaft core extends; a stator vane row adjacent to an upstream side of the rotor blade row in the axial direction for each of the plurality of rotor blade rows; a gap flow passage that extends toward a radially inner side from a steam main flow passage that extends in the axial direction; and a communication passage including a first end that communicates with the gap flow passage and a second end that communicates with a space where steam with higher pressure than pressure of the steam inside the gap flow passage exists.

4 Claims, 4 Drawing Sheets

(58) Field of Classification Search
USPC ..... 415/194
See application file for complete search history.

(56) References Cited

U.S. PATENT DOCUMENTS

| | | | | |
|---|---|---|---|---|
| 8,047,767 | B2 * | 11/2011 | Montgomery | F01D 11/00 415/101 |
| 2014/0271125 | A1 * | 9/2014 | Nomura | F01D 11/001 415/68 |
| 2015/0159497 | A1 | 6/2015 | Eldrid et al. | |

FOREIGN PATENT DOCUMENTS

| | | | |
|---|---|---|---|
| JP | H07-034807 | A | 2/1995 |
| JP | 2004-332616 | A | 11/2004 |
| JP | 2013-076341 | A | 4/2013 |
| JP | 2014-177869 | A | 9/2014 |
| JP | 2015-025404 | A | 2/2015 |
| JP | 2015-113835 | A | 6/2015 |

OTHER PUBLICATIONS

International Search Report for corresponding International Application No. PCT/JP2015/073513, dated Nov. 24, 2015 (4 pages).

* cited by examiner

STEAM TURBINE

TECHNICAL FIELD

The present invention relates to a steam turbine which is driven by steam.

BACKGROUND ART

A steam turbine includes a rotor which rotates about an axis and a casing which covers the rotor. The rotor includes a rotor shaft which extends in an axial direction about an axis and a plurality of stages of rotor blade rows which are fixed to an outer periphery of the rotor shaft and are arranged in the axial direction. The steam turbine includes a stator vane row which is fixed to an inner periphery of the casing and is disposed on an upstream side of each stage of the plurality of stages of rotor blade rows.

A steam turbine of Patent Document 1 includes a ring-shaped protrusion which protrudes from a downstream side end surface of an inner ring provided on an inner peripheral side of a stator vane of a stator vane row toward a downstream side thereof. In addition, the steam turbine includes a ring-shaped protrusion which protrudes from an upstream side end surface of a tubular rotor blade support portion provided on an inner peripheral side of a rotor blade configuring a rotor blade row toward an upstream side thereof. In addition, in the steam turbine, the ring-shaped protrusion on the stator vane side is disposed on the outer peripheral side of the ring-shaped protrusion on the rotor blade side, and the protrusions are provided to overlap each other in an axial direction. Accordingly, a gap between the stator vanes and the rotor blades is bent in a crank shape, and thus, steam flowing through a steam main flow passage is prevented from leaking from a gap between the rotor blade rows and the stator vane rows toward the inner peripheral side.

CITATION LIST

Patent Literature

[Patent Document 1] Japanese Unexamined Patent Application, First Publication No. 2015-25404

However, in order to improve efficiency of a steam turbine, the steam flowing through the steam main flow passage should be prevented from leaking.

One or more embodiments of the present invention provide a steam turbine capable of decreasing a leakage amount of steam flowing through the steam main flow passage and improving turbine efficiency.

SUMMARY OF INVENTION

According to one or more embodiments of the present invention, there is provided a steam turbine, including: a rotor shaft which includes a shaft core portion which rotates about an axis and a disk portion which is fixed to the shaft core portion and expands toward a radially outer side in the shaft core portion; a plurality of rotor blade rows which are fixed to an outer periphery of the disk portion and are arranged in an axial direction in which the shaft core portion extends; and a stator vane row which is adjacent to an upstream side of the rotor blade row in the axial direction for each of the plurality of rotor blade rows, in which a gap flow passage, which extends toward a radially inner side from a steam main flow passage which extends in the axial direction and through which steam flows, is formed in a gap between the stator vane row and the rotor blade row configuring a speed governing stage disposed on the most upstream side among a plurality of stages configured by combinations of the rotor blade rows and the stator vane rows disposed to be adjacent to upstream sides of the rotor blade row, and a communication passage includes a first end which communicates with the gap flow passage and a second end which communicates with a space in which steam having a higher pressure than a pressure of the steam inside the gap flow passage exists, and the communication passage is formed in the disk portion to which the rotor blade row of the speed governing stage is fixed.

According to one or more embodiments of this configuration, steam flows into the gap flow passage through the communication passage. Accordingly, the flow of the steam which leaks out from the steam main flow passage and flows through the gap flow passage is contracted. That is, the flow of the steam in the gap flow passage is obstructed, and thus, it is possible to decrease the amount of the steam leaking from the steam main flow passage to the gap flow passage.

According to one or more embodiments of the present invention, the steam turbine may further include a fin which is provided on the steam main flow passage side of the gap flow passage in the radial direction and extends from the rotor blade row toward the stator vane row.

Accordingly, in one or more embodiments, the fin is provided in the gap flow passage, and thus, an interval between the rotor blade row and the stator vane row of the speed governing stage is narrowed, and it is possible to further decrease an amount of steam flowing into the gap flow passage.

In a steam turbine according to one or more embodiments of the present invention, a flow passage width of the gap flow passage may be larger than a gap between a tip portion of the fin and an end portion on a downstream side of the stator vane row and may be smaller than a gap between an end portion on an upstream side of the rotor blade row of the speed governing stage and an end portion on a downstream side of the stator vane row of the speed governing stage.

Accordingly, in one or more embodiments, it is possible to form the gap flow passage which most effectively uses contraction flow effects by steam ejected from the communication passage.

In a steam turbine according to one or more embodiments of the present invention, the gap flow passage may include an outer peripheral side flow passage portion which extends from the steam main flow passage toward the radially inner side, an intermediate flow passage portion which is connected to the outer peripheral side flow passage portion and extends in the axial direction, and an inner peripheral side flow passage portion which extends from the intermediate flow passage portion toward the radially inner side.

Accordingly, in one or more embodiments, the gap flow passage is bent in a crank shape from the outer peripheral side toward the inner peripheral side, and thus, a flow passage resistance increases and it is possible to decrease the amount of the steam leaking out from the steam main flow passage.

According to one or more embodiments of the above-described steam turbine, steam flows from the communication passage into the gap flow passage formed in the gap between the stator vane row and the rotor blade row configuring the speed governing stage. Therefore, it is possible to decrease a leakage amount of steam flowing into the steam main flow passage and it is possible to improve turbine efficiency.

DETAILED DESCRIPTION OF EMBODIMENTS

Figure 1:
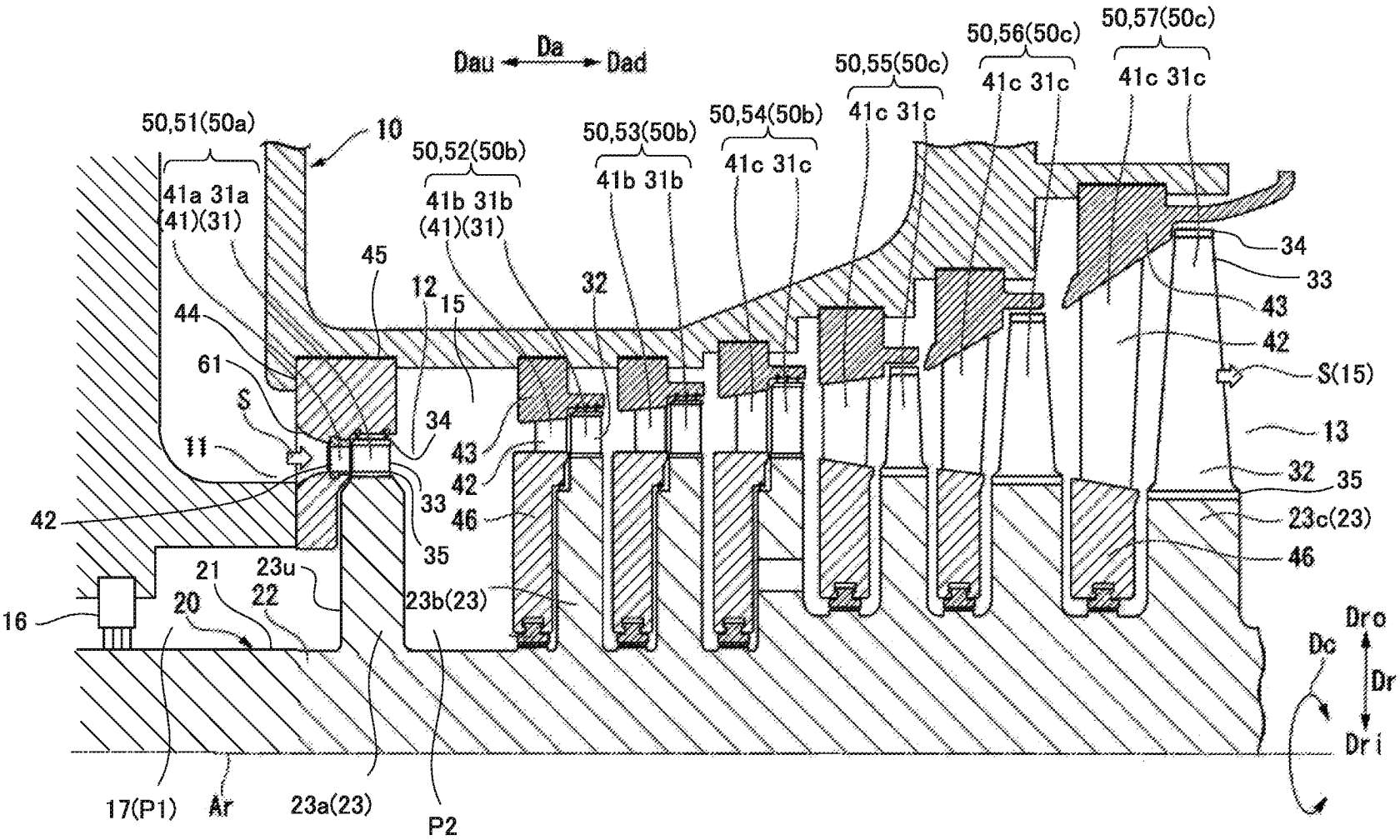
FIG. 1 is a sectional view of a steam turbine according to one or more embodiments of the present invention.
Figure 2:
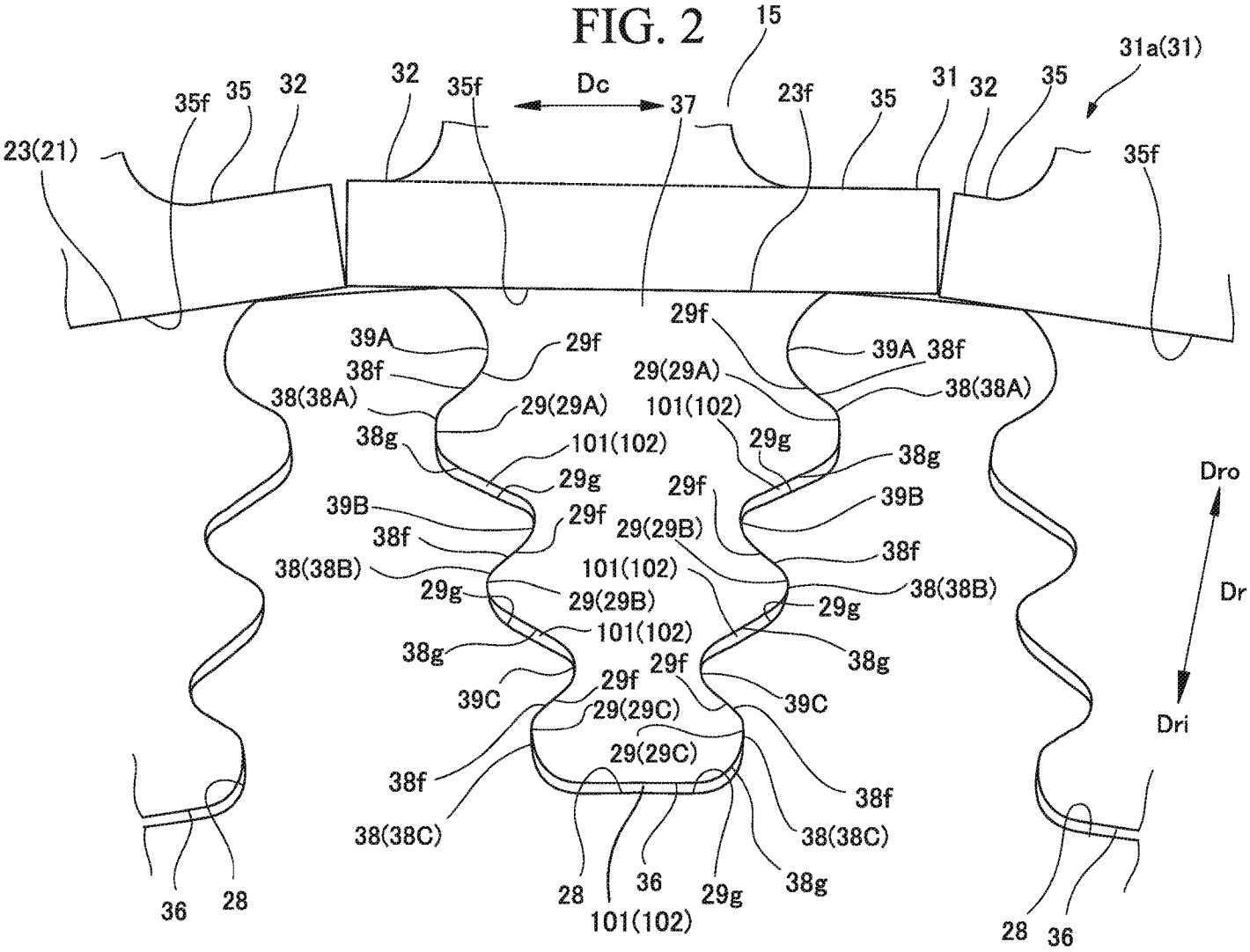
FIG. 2 is a view showing an attachment structure of a rotor blade to a disk portion in the steam turbine of one or more embodiments of the present invention.
Figure 3:
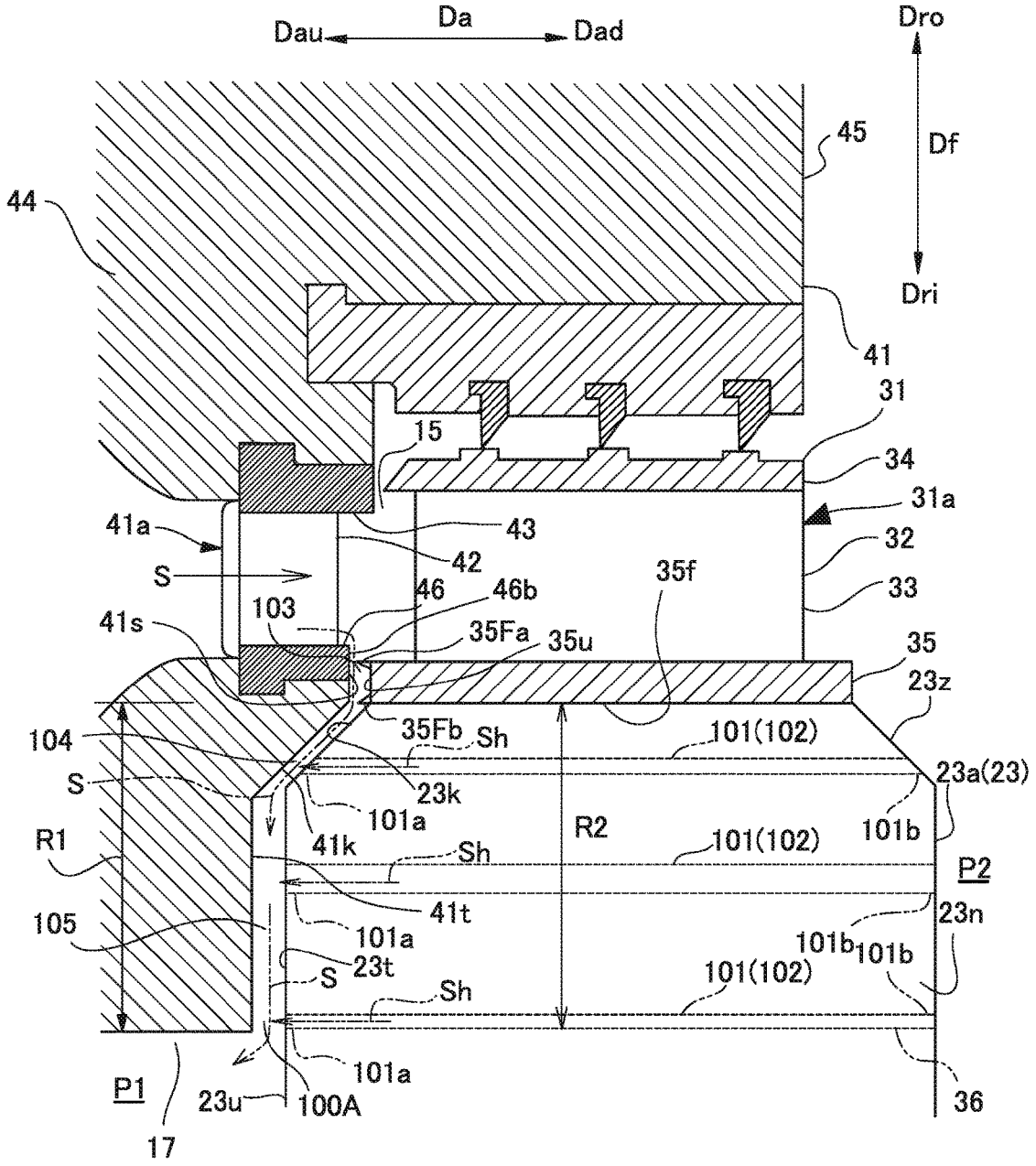
FIG. 3 is a sectional view of a stator vane row and a rotor blade row of a speed governing stage in the steam turbine of one or more embodiments of the present invention.

FIG. 1 is a sectional view of a steam turbine according to one or more embodiments of the present invention. FIG. 2 is a view showing an attachment structure of a rotor blade to a disk portion in the steam turbine of one or more embodiments of the present invention. FIG. 3 is a sectional view of a stator vane row and a rotor blade row of a speed governing stage in the steam turbine of one or more embodiments of the present invention.

As shown in FIG. 1, a steam turbine 1 of one or more embodiments includes a rotor 20 which rotates about an axis Ar and a casing 10 which covers the rotor 20 to be rotatable.

In addition, for convenience of the following descriptions, a direction in which the axis Ar extends is referred to an axial direction Da, a first side in the axial direction Da is referred to as an upstream side (one side, first side) Dau, and a second side in the axial direction Da is referred to as a downstream side (the other side, second side) Dad. Moreover, a radial direction in a shaft core portion 22 described later based on the axis Ar is simply referred to a radial direction Dr, a side close to the axis Ar in the radial direction Dr is referred to as a radially inner side Dri, and a side opposite to the radially inner side Dri in the radial direction Dr is referred to as a radially outer side Dro. In addition, a circumferential direction of the shaft core portion 22 about the axis Ar is simply referred to as a circumferential direction Dc.

The rotor 20 includes a rotor shaft 21 and a plurality of rotor blade rows 31 which are provided at intervals therebetween along the axial direction Da of the rotor shaft 21.

The rotor shaft 21 includes a shaft core portion 22 which is formed in a columnar shape about the axis Ar, and extends in the axial direction Da and a plurality of disk portions 23 which extend from the shaft core portion 22 toward the radially outer side Dro and are arranged at intervals therebetween in the axial direction Da. The disk portion 23 is provided for each of the plurality of rotor blade rows 31.

The rotor blade row 31 is attached to the outer periphery of the disk portion 23 which is an outer peripheral portion of the rotor shaft 21. The plurality of rotor blade rows 31 are provided at intervals therebetween along the axial direction Da of the rotor shaft 21. In the case of one or more embodiments, the number of the rotor blade rows 31 is seven. Accordingly, in the case of one or more embodiments, as the rotor blade rows 31, first to seventh stages of rotor blade rows 31 are provided.

In addition, the steam turbine 1 includes a plurality of stator vane rows 41 which are fixed to an inner periphery of the casing 10 and are provided at intervals therebetween along the axial direction Da. The stator vane row 41 is adjacent to an upstream side of the rotor blade row 31 in the axial direction Da for each of the plurality of rotor blade rows 31. In one or more embodiments, the number of the stator vane rows 41 is seven which is the same as the number of the rotor blade rows 31. Accordingly, in one or more embodiments, as the stator vane rows 41, first to seventh stages of stator vane rows 41 are provided. Each of the plurality of stator vane rows 41 is disposed to be adjacent to the upstream side Dau with respect to the rotor blade row 31.

In the casing 10, a nozzle chamber 11 into which steam S flows from the outside, a steam main flow passage chamber 12 into which the steam S from the nozzle chamber 11 flows, and an exhaust chamber 13 to which the steam S which flows from the steam main flow passage chamber 12 is discharged are formed. The rotor blade row 31 and the stator vane row 41, which are positioned on the most upstream side Dau among the plurality of rotor blade rows 31 and stator vane rows 41, are disposed between the nozzle chamber 11 and the steam main flow passage chamber 12. In other words, the inside of the casing 10 is divided into the nozzle chamber 11 and the steam main flow passage chamber 12 by the rotor blade row 31 and the stator vane row 41 positioned on the most upstream side Dau. In the steam main flow passage chamber 12, all the stator vane rows 41 and all the rotor blade rows 31 except for the rotor blade row 31 and the stator vane row 41 positioned on the most upstream side Dau among the plurality of rotor blade rows 31 and stator vane rows 41 are disposed.

One stage 50 is formed for each combination of the rotor blade row 31 and the stator vane row 41 disposed to be adjacent to the upstream side Dau of the rotor blade row 31. In the steam turbine 1 of one or more embodiments, the stator vane row 41 is provided with respect to each of seven rotor blade rows 31, and thus, seven stages 50 are provided. That is, the steam turbine 1 of one or more embodiments includes a first stage 51, a second stage 52, a third stage 53, a fourth stage 54, a fifth stage 55, a sixth stage 56, and a seventh stage 57 in this order from the upstream side Dau.

In the steam turbine 1 of one or more embodiments, the first stage 51 which is positioned on the most upstream side among the plurality of stages 50 configures a speed governing stage 50*a*. The speed governing stage 50*a* regulates a flow rate of the steam S fed to the stage 50 positioned on the downstream side Dad from the speed governing stage 50*a* so as to adjust a rotating speed of the rotor 20.

In the steam turbine 1 of one or more embodiments, the second stage 52, the third stage 53, and the fourth stage 54 configure an intermediate pressure stage 50*b*. In addition, in the steam turbine 1 of one or more embodiments, the fifth stage 55, the sixth stage 56, and the seventh stage 57 configure a low pressure stage 50*c*.

Accordingly, hereinafter, the stator vane row 41 of the first stage 51 configuring a portion of the speed governing stage 50*a* is referred to as a speed governing stage stator vane row 41*a*. The rotor blade row 31 of the first stage 51 configuring the other portion of the speed governing stage 50*a* is referred to as a speed governing stage rotor blade row 31*a*.

In addition, the stator vane row 41 of the second stage 52 to the stator vane row 41 of the fourth stage 54 configuring a portion of the intermediate pressure stage 50*b* are referred to as intermediate pressure stage stator vane rows 41*b*. The rotor blade row 31 of the second stage 52 to the rotor blade row 31 of the fourth stage 54 configuring the other portion of the intermediate pressure stage 50*b* are referred to as intermediate pressure stage rotor blade rows 31*b*.

In addition, the stator vane row 41 of the fifth stage 55 to the stator vane row 41 of the seventh stage 57 configuring a portion of the low pressure stage 50*c* are referred to as low pressure stage stator vane rows 41*c*. The rotor blade row 31 of the fifth stage 55 to the rotor blade row 31 of the seventh stage 57 configuring the other portion of the low pressure stage 50*c* are referred to as low pressure stage rotor blade rows 31*c*.

In addition, the disk portion 23 of the rotor shaft 21 to which the speed governing stage rotor blade row 31*a* is fixed is referred to as a speed governing stage disk portion 23*a*. The disk portions 23 of the rotor shaft 21 to which the intermediate pressure stage rotor blade rows 31*b* are fixed are referred to as intermediate pressure stage disk portions 23*b*. The disk portions 23 of the rotor shaft 21 to which the low pressure stage rotor blade rows 31*c* are fixed are referred to as low pressure stage disk portions 23*c*.

As shown in FIGS. 1 and 2, each rotor blade row 31 includes a plurality of rotor blades 32 which are arranged in the circumferential direction Dc. Each rotor blade 32 includes a blade body 33 which extends in the radial direction Dr, a shroud 34 which is provided on the radially outer side Dro of the blade body 33, a platform 35 which is provided on the radially inner side Dri of the blade body 33, and a blade root 36 (refer to FIG. 2) which is provided on the radially inner side Dri of the platform 35. In the rotor blade 32, a portion between the shroud 34 and the platform 35 configures a portion of the steam main flow passage 15 through which the steam S flows. The steam main flow passage 15 extends in the axial direction Da over the plurality of rotor blade rows 31 and the plurality of stator vane rows 41. The steam main flow passage 15 is formed in an annular shape around the rotor 20.

As shown in FIG. 3, axial fins (fins) 35Fa and 35Fb are provided in the speed governing stage rotor blade row 31*a*. The axial fins (fins) 35Fa and 35Fb are provided to face an opening of a gap flow passage 100A described later on the steam main flow passage 15 side in the radial direction Dr. The axial fins (fin) 35Fa and 35Fb extend from the speed governing stage rotor blade row 31*a* toward the speed governing stage stator vane row 41*a*.

The axial fins (fins) 35Fa and 35Fb of one or more embodiments are provided on the upstream side Dau of the platform 35 of the rotor blade 32 in the axial direction Da. The axial fin 35Fa is formed to protrude toward the upstream side Dau from the radially outer side Dro of an end surface 35*u* which is toward the upstream side Dau of the platform 35 in the axial direction Dau. The axial fin 35Fb is formed to protrude toward the upstream side Dau from the radially inner side Dri of the end surface 35*u* of the platform 35.

The clearance between the end surface 35*u* of the platform 35 which is a front edge portion of the rotor blade 32 of the speed governing stage rotor blade row 31*a* and an inner ring 46 described later which is a rear edge portion of the stator vane 42 of the speed governing stage stator vane row 41*a* is narrowed by the axial fins 35Fa and 35Fb. Accordingly, the axial fin 35Fa and the axial fin 35Fb prevent the steam S from leaking toward the radially inner side Dri from the steam main flow passage 15 extending in the axial direction Da toward the gap between the speed governing stage rotor blade row 31*a* and the speed governing stage stator vane row 41*a*.

As shown in FIG. 2, in each of the plurality of rotor blades 32 configuring the rotor blade row 31, as described later, the blade root 36 is fitted into a blade groove 28 formed on an outer peripheral portion of the disk portion 23 in the rotor shaft 21.

As shown in FIG. 2, in each rotor blade row 31, the blade root 36 of each rotor blade 32 is formed to extend from a platform inner peripheral surface 35*f* which is toward the radially inner side Dri of the platform 35 toward the radially inner side Dri. The blade root 36 includes a blade root body 37 which extends from the platform inner peripheral surface 35*f* toward the radially inner side Dri and an engaging protrusion portion 38 which protrudes from the blade root body 37 toward both sides in the circumferential direction Dc. The engaging protrusion portion 38 protrudes from the blade root body 37 at a plurality of locations spaced apart along the radial direction Dr. The engaging protrusion portion 38 engages with an engaging recessed portion 29 described later which is formed on the blade groove 28. In one or more embodiments, the engaging protrusion portion 38 is formed at three locations spaced apart along the radial direction Dr. Each of engaging protrusion portions 38A, 38B, and 38C has a curved surface shape which protrudes in a direction separated from the center in the circumferential direction Dc of the blade root 36 along the circumferential direction Dc in each of one side and the other side of the blade root 36 in the circumferential direction Dc.

Here, compared to the engaging protrusion portion 38A on the platform 35 side, the engaging protrusion portion 38B and the engaging protrusion portion 38C disposed on the radially inner side Dri of the engaging protrusion portion 38A are formed such that protrusion dimensions thereof in the circumferential direction Dc gradually decrease. In addition, in the blade root body 37, a first trunk 39A between the platform 35 and the engaging protrusion portion 38A, a second trunk 39B between the engaging protrusion portion 38A and the engaging protrusion portion 38B, and a third trunk 39C between the engaging protrusion portion 38B and the engaging protrusion portion 38C are formed such that width dimensions thereof in the circumferential direction Dc gradually decrease from the platform 35 side toward the radially inner side Dri. Accordingly, the blade root 36 is formed in a so-called Christmas tree shape.

In each engaging protrusion portion 38, a blade root outer surface 38*f* which is toward a direction including a directional component toward the radially outer side Dro is formed. The blade root outer surface 38*f* is a surface which is formed on the radially outer side Dro in the engaging protrusion portion 38. In addition, the direction of the blade root outer surface 38*f* may be any direction as long as it includes a directional component toward the radially outer side Dro, may be a direction parallel to the radial direction Dr, or may be a direction inclined to the radial direction Dr.

In addition, in each engaging protrusion portion 38, a blade root inner surface 38*g* which is toward a direction including a directional component toward the radially inner side Dri is formed. The blade root inner surface 38*g* is a surface which is formed on the radially inner side Dri in the engaging protrusion portion 38. In addition, the direction of the blade root inner surface 38*g* may be any direction as long as it includes a directional component toward the radially inner side Dri, may be a direction parallel to the radial direction Dr, or may be a direction inclined to the radial direction Dr.

The blade groove 28 which extends toward the radially inner side Dri is formed on the outer peripheral portion of each disk portion 23. The blade groove 28 is formed to be recessed from a rotor outer peripheral surface 23*f* formed on the radially outermost side Dro of the disk portion 23 toward the radially inner side Dri. The rotor outer peripheral surface 23*f* faces the platform inner peripheral surface 35*f*.

The blade groove 28 is formed to make up the outer peripheral shape of the blade root 36. The blade groove 28 includes the engaging recessed portion 29 recessed toward both side in the circumferential direction Dc at a plurality of locations spaced apart along the radial direction Dr. In one or more embodiments, the engaging recessed portion 29 is formed at three locations spaced apart along the radial direction Dr in each of one side and the other side of the blade groove 28 in the circumferential direction Dc. Each of engaging recessed portions 29A, 29B, and 29C formed at the three locations has a curved surface shape which is recessed in a direction separated from the center in the circumferential direction Dc of the blade groove 28 along the circumferential direction Dc.

Each engaging recessed portion 29 includes a blade groove inner surface 29*f* which is toward a direction including a directional component toward the radially inner side Dri. The blade groove inner surface 29*f* is a surface which is formed on the radially outer side Dro in the engaging recessed portion 29. In addition, the direction of the blade groove inner surface 29*f* may be any direction as long as it includes a directional component toward the radially inner side Dri, may be a direction parallel to the radial direction Dr, or may be a direction inclined to the radial direction Dr.

In addition, each engaging recessed portion 29 includes a blade groove outer surface 29*g* which is toward a direction including a directional component toward the radially outer side Dro. The blade groove outer surface 29*g* is a surface which is formed on the radially inner side Dri in the engaging recessed portion 29. In addition, the direction of the blade groove outer surface 29*g* may be any direction as long as it includes a directional component toward the radially outer side Dro, may be a direction parallel to the radial direction Dr, or may be a direction inclined to the radial direction Dr.

Here, if the rotor shaft 21 rotates around the axis Ar, the rotor blades 32 pivot about the axis Ar of the rotor shaft 21 along with the disk portion 23 of the rotor shaft 21. Accordingly, a centrifugal force is applied to the rotor blades 32. The rotor blades 32 are displaced toward the radially outer side Dro by the centrifugal force. As a result, the blade root outer surfaces 38*f* of the engaging protrusion portions 38A, 38B, and 38C abut on the blade groove inner surfaces 29*f* of the engaging recessed portions 29A, 29B, and 29C. That is, the rotor blade 32 is supported in a state where the blade root outer surfaces 38*f* of the blade root 36 and the blade groove inner surfaces 29*f* of the blade groove 28 come into contact with each other.

Meanwhile, the centrifugal force is generated in the rotor blades 32, and thus, a distance between the blade root inner surface 38*g* of each of the engaging protrusion portions 38A, 38B, and 38C and the blade groove outer surface 29*g* of each of the engaging recessed portions 29A, 29B, and 29C increases. As a result, a gap 101 between each blade root inner surface 38*g* and each blade groove outer surface 29*g* increases. As shown in FIG. 3, the gap 101 is formed to be continuous along the axial direction Da to communicate with the upstream side Dau and the downstream side Dad of the disk portion 23.

As shown in FIG. 3, the speed governing stage disk portion 23*a* includes, on an upstream surface 23*u* toward the upstream side Dau, a thick portion 23*n* which is set to have a thicker thickness along the axial direction Da than that of the platform 35 to increase strength. In addition, the speed governing stage disk portion 23*a* includes, on the radially outer side Dro of the thick portion 23*n*, the thickness increasing portion 23*z* in which a plate thickness in the axial direction Da gradually increases from the platform inner peripheral surface 35*f* side of the platform 35 toward the thick portion 23*n*.

Accordingly, in the speed governing stage disk portion 23*a*, a disk inclination surface 23*k* and an orthogonal surface 23*t* are formed on the upstream surface 23*u* which is toward the upstream side Dau. The disk inclination surface 23*k* is inclined on the upstream side Dau from the end surface 35*u* on the upstream side Dau of the platform 35 toward the radially inner side Dri. The orthogonal surface 23*t* extends to be orthogonal to the axial direction Da from the disk inclination surface 23*k* toward the radially inner side Dri.

As shown in FIG. 1, the stator vane row 41 includes the plurality of stator vanes 42 which are arranged in the circumferential direction Dc, an annular outer ring 43 which is provided on the radially outer side Dro of the plurality of stator vanes 42, and the annular inner ring 46 which is provided on the radially inner side Dri of the plurality of stator vanes 42. That is, the plurality of stator vanes 42 are disposed between the outer ring 43 and the inner ring 46. The stator vanes 42 are fixed to the outer ring 43 and the inner ring 46. An annular space between the outer ring 43 and the inner ring 46 configures a portion of the steam main flow passage 15 through which the steam S flows. The outer ring 43 includes a ring body portion 44 to which the plurality of stator vanes 42 are fixed and a ring protrusion portion 45 which protrudes from the ring body portion 44 toward the downstream side Dad. The ring protrusion portion 45 faces the shroud 34 of the rotor blade row 31, which is adjacent to the downstream side Dad of the stator vane row 41, at an interval therebetween in the radial direction Dr.

In the speed governing stage stator vane row 41*a* among the plurality of stator vane row 41, a first orthogonal surface 41*s*, an inclination surface 41*k*, and a second orthogonal surface 41*t* are formed.

The first orthogonal surface 41*s* faces the end surface 35*u* of the platform 35 of the speed governing stage rotor blade row 31*a*. The inclination surface 41*k* faces the disk inclination surface 23*k* of the disk portion 23 on the radially inner side Dri of the first orthogonal surface 41*s*. The second orthogonal surface 41*t* faces the orthogonal surface 23*t* of the disk portion 23 on the radially inner side Dri of the inclination surface 41*k*.

The first orthogonal surface 41*s*, the inclination surface 41*k*, and the second orthogonal surface 41*t* are formed to be approximately parallel to the end surface 35*u*, the disk inclination surface 23*k*, and the orthogonal surface 23*t* with predetermined clearances along the axial direction Da.

In this way, the gap flow passage 100A which extends from the steam main flow passage 15 to the radially inner side Dri is formed in a gap between the speed governing stage stator vane row 41*a* and the speed governing stage rotor blade row 31*a*. In one or more embodiments, the gap flow passage 100A includes an outer peripheral side flow passage portion 103 which extends toward the radially inner side Dri, an inclination flow passage portion 104 which is inclined to the upstream side Dau from the outer peripheral side flow passage portion 103 toward the radially inner side Dri, and an inner peripheral side flow passage portion 105 which extends from the inclination flow passage portion 104 toward the radially inner side Dri.

The outer peripheral side flow passage portion 103 is formed between the end surface 35*u* of the platform 35 and the first orthogonal surface 41*s*. The outer peripheral side flow passage portion 103 extends from the steam main flow passage 15 to the inclination flow passage portion 104.

The inclination flow passage portion 104 is formed between the inclination surface 41*k* and the disk inclination surface 23*k*. The inclination flow passage portion 104 is formed as a flow passage which is continuous to the outer peripheral side flow passage portion 103.

The inner peripheral side flow passage portion 105 is formed between the second orthogonal surface 41*t* and the orthogonal surface 23*t*. The inner peripheral side flow passage portion 105 is formed as a flow passage which is continuous to the inclination flow passage portion 104.

Here, the gap flow passage 100A may be formed such that a length dimension R1 in the radial direction Dr is the same as a length R2 of the blade root 36 of the rotor blade 32 in the radial direction Dr or is longer than the length R2.

The inner peripheral side flow passage portion 105 of the gap flow passage 100A is connected to a space 17, in which a plurality of seal members 16 such as a labyrinth seal are provided, on the radially inner side Dri of the nozzle chamber 11. The seal members 16 are provided on the radially inner side Dri of the nozzle chamber 11. The seal members 16 perform sealing so as to prevent steam from leaking out from a portion between the shaft core portion 22 and the casing 10 to the outside of the casing 10. The space 17 communicates with the outside of the steam turbine 1 via the seal members 16. Accordingly, a pressure P1 in the space 17 is lower than a pressure P2 in the steam main flow passage chamber 12 and, for example, is set to approximately 1 atm.

In addition, in the gap flow passage 100A, flow passage widths of the outer peripheral side flow passage portion 103, the inclination flow passage portion 104, and the inner peripheral side flow passage portion 105 are formed to be larger than a clearance in the axial direction Da between the tip portions of the axial fins 35Fa and 35Fb and a rear end 46*b* of the inner ring 46 which is an end portion on the downstream side of the speed governing stage stator vane row 41*a*. In addition, the flow passage widths are formed to be smaller than a clearance between the end surface 35*u* of the platform 35 which is an end portion on the upstream side of the speed governing stage rotor blade row 31*a* and the rear end 46*b* of the inner ring 46 of the speed governing stage stator vane row 41*a*.

An upstream end portion 101*a* which is a first end in the axial direction Da of the gap 101 between each rotor blade 32 and the blade groove 28 of the speed governing stage rotor blade row 31*a* is connected to the gap flow passage 100A. In the gap 101, steam of the steam main flow passage chamber 12, in which steam having the higher pressure P2 than the pressure P1 of the steam inside the space 17 exists, flows from the downstream end portion 101*b* which is a second end in the axial direction Da toward the upstream end portion 101*a*. That is, as shown in FIG. 2, the gap 101 which is formed between each of the blade root inner surfaces 38*g* of the engaging protrusion portions 38A, 38B, and 38C and each of the blade groove outer surfaces 29*g* of the engaging recessed portions 29A, 29B, and 29C functions as a communication passage 102. Accordingly, the gap flow passage 100A communicates with the steam main flow passage chamber 12, in which steam having the higher pressure P2 than the pressure P1 of the steam inside the space 17 exists, via the communication passages 102.

As shown in FIG. 3, in the gap flow passage 100A, a portion of steam of the steam main flow passage 15 passing through the stator vane 42 of the speed governing stage stator vane row 41*a* from the nozzle chamber 11 flows into the gap flow passage 100A from the gap between the rear end 46*b* of the inner ring 46 and the end surface 35*u* of the platform 35 of the speed governing stage rotor blade row 31*a*.

Meanwhile, steam Sh in the steam main flow passage chamber 12 having the higher pressure P2 than that of the space 17 flows to be ejected to the gap flow passage 100A through the communication passage 102. Accordingly, in the gap flow passage 100A, the flow of the steam S which flows from the steam main flow passage 15 to the gap flow passage 100A is contracted by the high-pressure steam Sh ejected from the communication passages 102. According to the contraction flow effects, it is possible to prevent the steam S flowing into the gap flow passage 100A from being included in the flow.

As described above, according to the steam turbine 1 of one or more embodiments, a portion of the steam S flowing through the steam main flow passage 15 flows into the gap flow passage 100A. In the gap flow passage 100A, the steam Sh inside the steam main flow passage chamber 12 having a higher pressure than the pressure of the steam S inside the space 17 flows into the gap flow passage 100A through the communication passages 102. Accordingly, the flow of the steam S which leaks out from the steam main flow passage 15 and flows through the gap flow passage 100A is contracted. That is, the flow of the steam S which flows from the steam main flow passage 15 to the gap flow passage 100A is obstructed, and thus, it is possible to decrease the amount of the steam S leaking from the steam main flow passage 15 to the gap flow passage 100A. Therefore, it is possible to decrease a leakage amount toward the radially inner side Dri of the steam S flowing through steam main flow passage 15, and it is possible to improve turbine efficiency.

In addition, the axial fins 35Fa and 35Fb extending from the rotor blade row 31 side toward the stator vane row 41 side are provided in the gap flow passage 100A. Accordingly, the interval in the axial direction Da between the speed governing stage rotor blade row 31*a* and the speed governing stage stator vane row 41*a* is narrowed, and thus, it is possible to further decrease the amount of the steam S flowing into the gap flow passage 100A. Accordingly, it is possible to further decrease the leakage amount toward the radially inner side Dri of the steam S flowing through steam main flow passage 15.

In addition, the flow passage width of the gap flow passage 100A are formed to be larger than the clearance in the axial direction Da between the tip portions of the axial fins 35Fa and 35Fb and the rear end 46*b* of the inner ring 46 of the speed governing stage stator vane row 41*a*. Accordingly, a gap flow passage 100A having the minimum necessary flow passage width can be formed between the speed governing stage rotor blade row 31*a* and the speed governing stage stator vane row 41*a*. Accordingly, it is possible to form the gap flow passage 100A which most effectively uses the contraction flow effects by the steam Sh ejected from the communication passage 102.

In addition, the flow passage width of the gap flow passage 100A is formed to be smaller than the clearance between the end surface 35*u* of the platform 35 of the speed governing stage rotor blade row 31*a* and the rear end 46*b* of the inner ring 46 of the speed governing stage stator vane row 41*a*. Accordingly, it is possible to form the gap flow passage 100A such that the portion between the speed governing stage rotor blade row 31*a* and the speed governing stage stator vane row 41*a* is prevented from being too wide in order to prevent reduction in effects of the steam Sh ejected from the communication passages 102.

Therefore, the gap flow passage 100A is formed to have the above-described flow path width, and thus, it is possible to form the gap flow passage 100A which effectively uses the contraction flow effects by the steam Sh ejected from the communication passage 102.

Next, additional embodiments of the steam turbine according to the present invention will be described. Compared to the steam turbine of the above-described embodiments, in the steam turbine of the embodiments described below, only a gap flow passage 100B is different. Accordingly, the same reference numerals are assigned to the same portions of the above-described embodiments, and overlapping descriptions thereof are omitted. That is, all the configurations of the steam turbine common to the configurations described above will be omitted.

Figure 4:
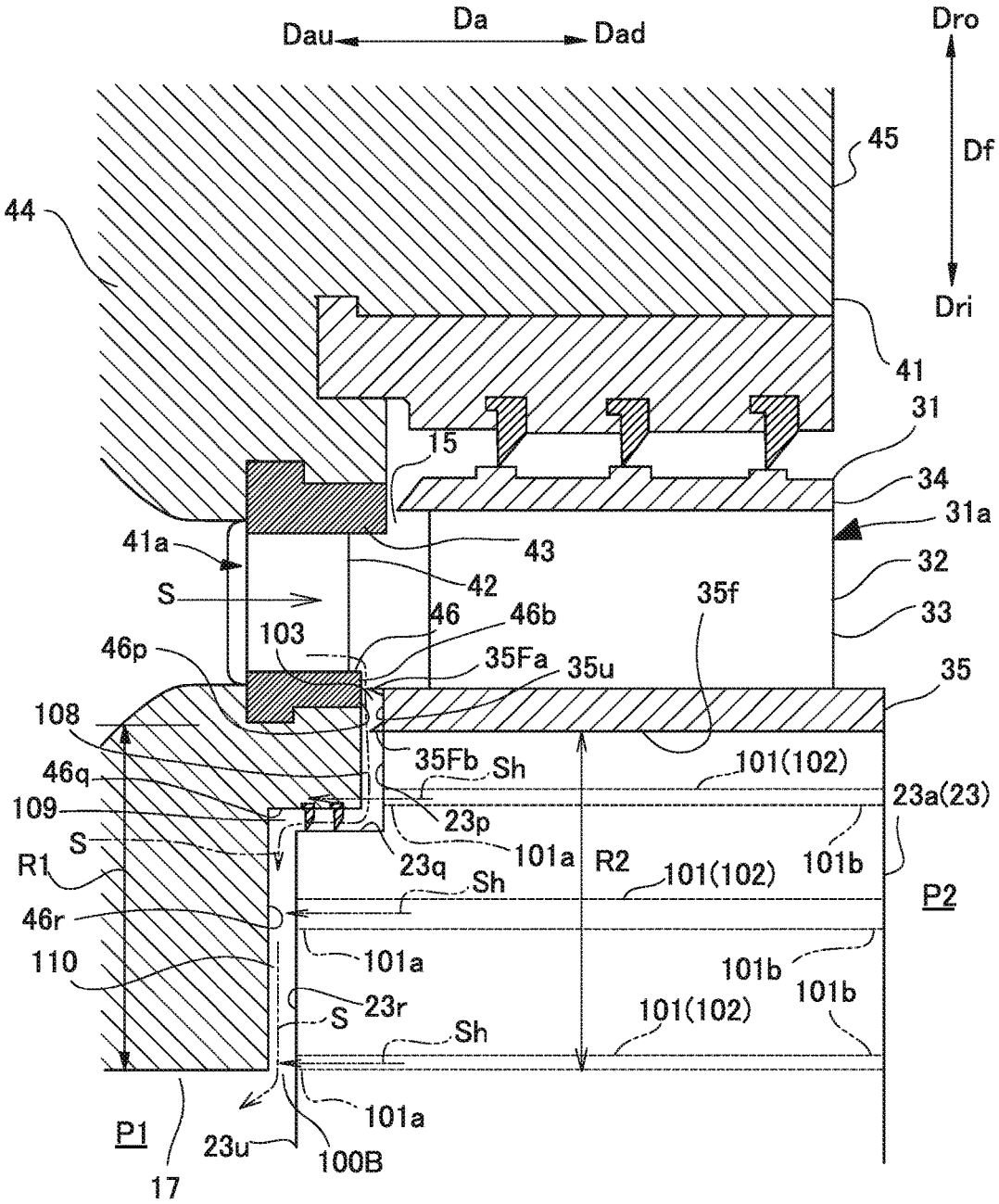
FIG. 4 is a sectional view of a stator vane row and a rotor blade row of a speed governing stage in a steam turbine of one or more embodiments of the present invention.

FIG. 4 is a sectional view of a stator vane row and a rotor blade row of a speed governing stage in the steam turbine of one or more embodiments of the present invention.

As shown in FIG. 4, in the steam turbine 1 of one or more embodiments, in the disk portion 23 of the rotor blade row 31 of the speed governing stage 50*a*, a first orthogonal surface 23*p*, a disk intermediate peripheral surface 23*q*, and a disk second orthogonal surface 23*r* are formed on the upstream surface 23*u* toward the upstream side Dau.

The disk first orthogonal surface 23*p* extends to be orthogonal to the axial direction Da from the end surface 35*u* of the platform 35 on the upstream side Dau toward the radially inner side Dri. The disk intermediate peripheral surface 23*q* extends from the disk first orthogonal surface 23*p* toward the upstream side Dau along the axial direction Da and is toward the radially outer side Dro. The disk second orthogonal surface 23*r* extends to be orthogonal to the axial direction Da from the upstream side Dau of the disk intermediate peripheral surface 23*q* toward the radially inner side Dri.

In the speed governing stage stator vane row 41*a* of one or more embodiments, a first orthogonal surface 46*p*, an intermediate peripheral surface 46*q*, and a second orthogonal surface 46*r* are formed.

The first orthogonal surface 46*p* faces the end surface 35*u* of the platform 35 of the speed governing stage rotor blade row 31*a* and the disk first orthogonal surface 23*p* of the speed governing stage disk portion 23*a*.

The intermediate peripheral surface 46*q* extends from the disk first orthogonal surface 46*p* toward the upstream side Dau along the axial direction Da and is toward the radially inner side Dri.

The second orthogonal surface 46*r* extends to be orthogonal to the axial direction Da from the upstream side Dau of the intermediate peripheral surface 46*q* toward the radially inner side Dri.

The end surface 35*u*, the disk first orthogonal surface 23*p*, the disk intermediate peripheral surface 23*q*, and the disk second orthogonal surface 23*r*, and the first orthogonal surface 46*p*, the intermediate peripheral surface 46*q*, and the second orthogonal surface 46*r* are respectively formed to be approximately parallel to each other with predetermined clearances. That is, the gap flow passage 100B is formed by the end surface 35*u*, the disk first orthogonal surface 23*p*, the disk intermediate peripheral surface 23*q*, and the disk second orthogonal surface 23*r* and the first orthogonal surface 46*p*, the intermediate peripheral surface 46*q*, and the second orthogonal surface 46*r*.

In addition, a seal fin is provided on the intermediate peripheral surface 46*q*. The seal fin 60 protrudes from the intermediate peripheral surface 46*q* to the disk second orthogonal surface 23*r* toward the radially inner side Dri.

In addition, a seal member provided on the intermediate peripheral surface 46*q* is not limited to the seal fin 60 and may be any member as long as it can seal a portion between the intermediate peripheral surface 46*q* and the disk second orthogonal surface 23*r*. For example, a labyrinth seal may be provided between the intermediate peripheral surface 46*q* and the disk second orthogonal surface 23*r*.

The gap flow passage 100B formed between the speed governing stage stator vane row 41*a* and the speed governing stage rotor blade row 31*a* includes an outer peripheral side flow passage portion 108, an intermediate flow passage portion 109, and an inner peripheral side flow passage portion 110.

The outer peripheral side flow passage portion 108 is provided between the end surface 35*u* of the platform 35 and the disk first orthogonal surface 23*p*, and the first orthogonal surface 46*p*. The outer peripheral side flow passage portion 108 extends from the steam main flow passage 15 toward the radially inner side Dri.

The intermediate flow passage portion 109 is provided between the disk intermediate peripheral surface 23*q* and the intermediate peripheral surface 46*q*. The intermediate flow passage portion 109 is connected to the outer peripheral side flow passage portion 108 and extends from the outer peripheral side flow passage portion 108 toward the upstream side Dau in the axial direction Da.

The inner peripheral side flow passage portion 110 is formed between disk second orthogonal surface 23*r* and the second orthogonal surface 46*r*. The inner peripheral side flow passage portion 110 extends from the intermediate flow passage portion 109 to the space 17 toward the radially inner side Dri.

The upstream end portions 101*a* of the gaps 101 between the rotor blades 32 and the blade grooves 28 of the speed governing stage rotor blade row 31*a* are connected to the gap flow passage 100B. In each of the gaps 101, the steam of the steam main flow passage chamber 12, in which steam having the higher pressure P2 than the pressure P1 of the steam inside the space 17 exists, flows from the downstream end portion 101*b* toward the upstream end portion 101*a*. That is, as shown in FIG. 2, the gap 101 which is formed between each of the blade root inner surfaces 38*g* of the engaging protrusion portions 38A, 38B, and 38C and each of the blade groove outer surfaces 29*g* of the engaging recessed portions 29A, 29B, and 29C functions as a communication passage 102.

As shown in FIG. 4, in the gap flow passage 100B, a portion of steam of the steam main flow passage 15 passing through the speed governing stage stator vane row 41*a* from the nozzle chamber 11 flows into the gap flow passage 100B from the gap between the rear end 46*b* of the inner ring 46 and the end surface 35*u* of the platform 35 of the speed governing stage rotor blade row 31*a*.

Meanwhile, the steam Sh in the steam main flow passage chamber 12 having a high pressure flows to be ejected to the gap flow passage 100B through the communication passage 102. Accordingly, in the gap flow passage 100B, the flow of steam Sn which flows from the steam main flow passage 15 to the gap flow passage 100B is contracted by the high-pressure steam Sh ejected from the communication passages 102. According to the contraction flow effects, it is possible to prevent the steam Sn flowing into the gap flow passage 100B from being included in the flow.

According to the steam turbine 1 of one or more embodiments, a portion of the steam S flowing through the steam main flow passage 15 flows into the outer peripheral side flow passage portion 108 of the gap flow passage 100B. The steam S which flows into the outer peripheral side flow passage portion 108 flows to the space 17 via the intermediate flow passage portion 109 and the inner peripheral side flow passage portion 110. In this case, in the gap flow passage 100B, the steam Sh inside the steam main flow passage chamber 12 having a higher pressure than the pressure of the steam S inside the space 17 flows into the gap flow passage 100B through the communication passages 102. Accordingly, the flow of the steam S flowing through the outer peripheral side flow passage portion 108 or the inner peripheral side flow passage portion 110 of the gap flow passage 100B is contracted. That is, the flow of the steam S which flows from the steam main flow passage 15 to the gap flow passage 100B is obstructed, and thus, it is possible to decrease the amount of the steam S leaking from the steam main flow passage 15 to the gap flow passage 100B. Therefore, it is possible to decrease the leakage amount toward the radially inner side Dri of the steam S flowing through steam main flow passage 15, and it is possible to improve turbine efficiency.

In addition, the gap flow passage 100B is largely bent in a crank shape from the radially outer side Dro toward the radially inner side Dri in order of the outer peripheral side flow passage portion 108, the intermediate flow passage portion 109, and the inner peripheral side flow passage portion 110. Accordingly, a flow passage resistance of the gap flow passage 100B increases, and thus, it is possible to decrease the amount of the steam S leaking out from the steam main flow passage 15.

In addition, the seal fin 60 extending to the radially inner side Dri is provided in the intermediate flow passage portion 109 which is a portion which is bent in a crank shape. Accordingly, it is possible to increase sealability in the gap flow passage 100B.

Other Embodiments

In addition, the present invention is not limited to the above-described embodiments and design can be changed within a scope which does not depart from the gist of the present invention.

For example, the gap 101 formed between the blade root inner surfaces 38*g* of the engaging protrusion portions 38A, 38B, and 38C of each rotor blade 32 and the blade groove outer surfaces 29*g* of the engaging recessed portions 29A, 29B, and 29C of the blade groove 28 is used as the communication passage 102. However, the present invention is not limited to this.

For example, the communication passage 102 is not limited to the portions between the blade root inner surfaces 38*g* of the engaging protrusion portions 38A, 38B, and 38C and the blade groove outer surfaces 29*g* of the engaging recessed portions 29A, 29B, and 29C of the blade groove 28, and the communication passage 102 which communicates with the upstream side Dau and the downstream side Dad of the disk portion 23 may be formed in an inner peripheral portion of the blade root 36 or between the blade grooves 28 adjacent to each other in the circumferential direction Dc in the disk portion 23.

In addition, recessed portions formed on the blade root inner surfaces 38*g* of the engaging protrusion portions 38A, 38B, and 38C of each rotor blade 32 to be recessed from the blade root inner surfaces 38*g* toward the radially outer side Dro may be the communication passages 102. Moreover, recessed portions formed on the blade groove outer surfaces 29*g* of the engaging recessed portions 29A, 29B, and 29C of the blade groove 28 to be recessed from the blade groove outer surfaces 29*g* toward the radially inner side Dri may be the communication passages 102.

In addition, the configuration of each portion of the steam turbine 1 can be appropriately changed.

INDUSTRIAL APPLICABILITY

Steam flows from the communication passage into the gap flow passage formed in the gap between the stator vane row and the rotor blade row configuring the speed governing stage. Accordingly, it is possible to decrease a leakage amount of steam flowing into the steam main flow passage and it is possible to improve turbine efficiency.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1: steam turbine
10: casing
11: nozzle chamber
12: steam main flow passage chamber
13: exhaust chamber
15: steam main flow passage
16: seal member
17: space
20: rotor
21: rotor shaft
22: shaft core portion
23: disk portion
23*f*: rotor outer peripheral surface
23*k*: disk inclination surface
23*n*: thick portion
23*p*: disk first orthogonal surface
23*q*: disk intermediate peripheral surface
23*r*: disk second orthogonal surface
23*t*: orthogonal surface
23*u*: upstream surface
23*z*: thickness increasing portion
28: blade groove
29, 29A, 29B, 29C: engaging recessed portion
29*f*: blade groove inner surface
29*g*: blade groove outer surface
31: rotor blade row
32: rotor blade
33: blade body
34: shroud
35: platform
35Fa, 35Fb: axial fin (fin)
35*f*: platform inner peripheral surface
35*u*: end surface
36: blade root
38, 38A, 38B, 38C: engaging protrusion portion
38*f*: blade root outer surface
38*g*: blade root inner surface
39A: first trunk
39B: second trunk
39C: third trunk
41: stator vane row
41*k*: inclination surface
41*s*, 46*p*: first orthogonal surface
41*t*, 46*r*: second orthogonal surface
42: stator vane
43: outer ring
44: ring body portion
45: ring protrusion portion
46: inner ring
46*d*: downstream surface
46*b*: rear end
46*q*: intermediate peripheral surface
50: stage

50*a*: speed governing stage
50*b*: intermediate pressure stage
50*c*: low pressure stage
60: seal fin
100A, 100B: gap flow passage
101: gap
101*a*: upstream end portion
101*b*: downstream end portion
102: communication passage
103, 108: outer peripheral side flow passage portion
104: inclination flow passage portion
105, 110: inner peripheral side flow passage portion
109: intermediate flow passage portion
121, 122: recessed portion
Ar: axis
Da: axial direction
Dad: downstream side
Dau: upstream side
Dc: circumferential direction
Dr: radial direction
Dri: radially inner side
Dro: radially outer side
P1: pressure
P2: pressure
R1: dimension
S, Sh: steam

What is claimed is:

1. A steam turbine, comprising:

a rotor shaft comprising:

a shaft core that rotates about an axis; and a disk portion that is fixed to the shaft core and expands toward a radially outer side in the shaft core;

a plurality of rotor blade rows that are fixed to an outer periphery of the disk portion and are arranged in an axial direction in which the shaft core extends;

a stator vane row that is adjacent to an upstream side of the rotor blade row in the axial direction for each of the plurality of rotor blade rows;

a gap flow passage through which steams flows and that extends toward a radially inner side from a steam main flow passage that extends in the axial direction, wherein the gap flow passage is formed in a gap between the stator vane row and the rotor blade row configuring a speed governing stage disposed on the most upstream side among a plurality of stages configured by combinations of the rotor blade rows and the stator vane rows disposed to be adjacent to upstream sides of the rotor blade row, and a communication passage comprising:

a first end that communicates with the gap flow passage on a surface of the disk portion facing the stator vane row; and a second end that communicates with the steam main flow passage in which steam having a higher pressure than a pressure of the steam inside the gap flow passage exists, wherein the communication passage is formed in the disk portion to which the rotor blade row of the speed governing stage is fixed and is formed to be continuous along the axial direction, wherein the gap flow passage is connected to a space which communicates with an outside of the steam turbine.

2. The steam turbine according to claim 1, further comprising:

a fin that is provided on the steam main flow passage side of the gap flow passage in the radial direction and extends from the rotor blade row toward the stator vane row.

3. The steam turbine according to claim 2, wherein a flow passage width of the gap flow passage is larger than a gap between a tip portion of the fin and an end portion on a downstream side of the stator vane row and is the largest between an end portion on an upstream side of the rotor blade row of the speed governing stage and an end portion on a downstream side of the stator vane row of the speed governing stage.

4. The steam turbine according to claim 1, wherein the gap flow passage comprises:

an outer peripheral side flow passage portion that extends from the steam main flow passage toward the radially inner side;

an intermediate flow passage portion that is connected to the outer peripheral side flow passage portion and extends in the axial direction; and an inner peripheral side flow passage portion that extends from the intermediate flow passage portion toward the radially inner side.

* * * * *